United States Patent [19]

Short

[11] Patent Number: 4,867,694

[45] **Date of Patent: * Sep. 19, 1989**

[54] SAFETY ELECTRICAL RECEPTACLE

[75] Inventor: Stephen P. Short, Johnston, R.I.

[73] Assignee: General Electric Company, Schenectady, N.Y.

[ * ] Notice: The portion of the term of this patent subsequent to Sep. 19, 2006 has been disclaimed.

[21] Appl. No.: 226,653

[22] Filed: Aug. 1, 1988

[51] Int. Cl.[4] ..... H01R 13/44

[52] U.S. Cl. ..... 439/137

[58] Field of Search ..... 439/137–140

[56] References Cited

U.S. PATENT DOCUMENTS

| | | | |
|---|---|---|---|
| 2,545,536 | 10/1948 | von Holtz | 173/330 |
| 2,770,786 | 10/1952 | Czyzewski | 339/40 |
| 3,222,631 | 12/1963 | Cohen | 339/40 |
| 3,238,492 | 1/1964 | Houston | 339/40 |
| 3,986,763 | 10/1976 | Sparrow | 339/40 |
| 3,990,758 | 11/1976 | Petterson | 339/43 |
| 4,072,382 | 2/1978 | Reschke | 339/40 |
| 4,094,569 | 6/1978 | Dietz | 339/40 |
| 4,168,104 | 9/1979 | Buschow | 339/40 |
| 4,379,607 | 4/1983 | Bowden, Jr. | 339/40 |
| 4,544,219 | 10/1985 | Barkas | 339/40 |
| 4,722,693 | 2/1988 | Rose | 439/137 |
| 4,822,290 | 4/1989 | Cauley et al. | 439/137 |

FOREIGN PATENT DOCUMENTS

| | | | |
|---|---|---|---|
| 0243793 | 1/1961 | Australia | 439/137 |
| 751236 | 2/1953 | Fed. Rep. of Germany . | |
| 1440799 | 11/1962 | Fed. Rep. of Germany . | |
| 1465128 | 12/1964 | Fed. Rep. of Germany . | |
| 2434577 | 1/1976 | Fed. Rep. of Germany | 439/137 |
| 2434578 | 1/1976 | Fed. Rep. of Germany | 439/137 |
| 2038508 | 3/1978 | Fed. Rep. of Germany . | |
| 1311993 | 11/1962 | France . | |
| 1448863 | 6/1965 | France . | |
| 1425461 | 12/1965 | France . | |
| 210641 | 1/1967 | Sweden . | |
| 216519 | 10/1967 | Sweden . | |
| 314729 | 11/1967 | Sweden . | |
| 217538 | 12/1967 | Sweden . | |
| 230573 | 11/1942 | Switzerland . | |
| 239441 | 9/1943 | Switzerland . | |
| 1585094 | 2/1981 | United Kingdom . | |

*Primary Examiner*—P. Austin Bradley

*Attorney, Agent, or Firm*—Edward M. Corcoran; Stanley C. Corwin; Fred Jacob

[57] ABSTRACT

An electrical receptacle is provided with a shutter mechanism to block spurious insertion of a foreign object through one of the receptacle slots short of the receptacle power circuit contacts. This mechanism includes either one or two slides supported for movement between closed-latched and open positions. Access to the contacts requires the slides first be unlatched by a blade penetrating one receptacle slot and then cammed to open positions by another blade penetrating the other receptacle slot, as occurs incident to the insertion of a standard electrical plug into the receptacle.

20 Claims, 7 Drawing Sheets

SAFETY ELECTRICAL RECEPTACLE

The present invention relates to electrical wiring devices and particularly to electrical receptacles of the safety or protective type which accept the insertion of a standard electrical plug, but inhibit the insertion of a foreign object into contact with electrically live parts thereof.

BACKGROUND OF THE INVENTION

It is well known that the multiplicity of electrical outlets or receptacles distributed about a dwelling represents a clear and present danger to curious children. Since a conventional receptacle provides clear, unobstructed paths from the slots in its face to the plug-in contacts therebehind for accepting the insertion of the blades of a standard electrical plug, the absence of the plug renders the contacts accessible to children inserting a thin, elongated object. If the object is metallic, such a a hairpin, paper clip, nail file, or the like, and is inserted into engagement with the live contacts of the receptacle, a serious, even fatal shock may be the tragic result.

There have been numerous approaches and designs proposed in an attempt to render electrical receptacles child-resistant. Perhaps the simplest approach is to insert the prongs of a plastic protective cap into the slots of all unused receptacles that are accessible to children. However, the reliability of this approach depends on the diligence of adults to ensure that protective caps are installed in all unused receptacles. Moreover, these protective caps are not particularly difficult to remove, even for children. An analogous and more reliable approach is to permanently mount a protective cap to the face of the receptacle having slots which are normally nonaligned with the receptacle slots. The cap is then manipulated to a position aligning its slots with the receptacle slots, whereupon the blades of a standard plug have access the receptacle contacts.

Another basic approach has been to provide internal switches which can be actuated only by the concurrent insertions of a pair of plug blades to connect the receptacle contacts into the branch electrical circuit wired to the receptacle terminals. Thus, unless the switches are actuated, the receptacle contacts are dead and therefore safe to the touch by a conductive foreign object inserted into one of the receptacle slots.

Yet another basic approach is to provide shutters which are normally positioned to block access to the receptacle contacts for foreign object inserted through either one of the receptacle slots, but are readily shifted to unblocking positions by the concurrent insertion of the blades of a standard electrical plug. The probability of a child simultaneously inserting foreign objects into both receptacle slots is so remote that this shuttered approach is considered reliably child-resistant.

It is an object of the present invention to provide an improved safety electrical receptacle.

A further object is to provide a safety electrical receptacle capable of universally accepting a variety of standard electrical plug blade configurations.

Another object is to provide a safety electrical receptacle of the above-character which is reliably child-resistant, yet is as convenient and facile to use for its intended purpose as conventional receptacles.

An additional object is to provide a safety receptacle of the above-character, which is inexpensive to manufacture in quantity, durable in construction, and reliable in operation over a long useful life.

Other objects of the invention will in part be obvious and in part appear hereinafter.

SUMMARY OF THE INVENTION

In accordance with the present invention, there is provided a safety electrical receptacle in which is incorporated a shutter mechanism at a location intermediate the receptacle slots and the receptacle line and neutral plug-in contacts. This shutter mechanism includes a stationary retainer serving to support a slide for movement between a spring-biased, closed-latched position blocking access to the receptacle contacts and an open position granting access to these contacts through a series of intermediate access blocking positions. The slide includes a latch actuating nose and an underlying barrier ledge which are disposed in the plug blade insertion path through one receptacle slot to one of the receptacle plug-in contacts when the slide is in its closed-latched position. The slide further includes a slide actuating ramp disposed in blocking relation with the plug blade insertion path through the other receptacle slot to the other plug-in contacts.

To shift the slide to its open position unblocking the blade insertion paths, its nose must be depressed to unlatch the slide and shift it to a closed-unlatched position. Only then can engagement of the ramp successfully cam the slide to its open position. These coordinated events naturally occur incident to the concurrent insertions of the blades of any conventional electrical plug, and thus complete access to the receptacle contacts is granted to the blades. The sole insertion of a blade-like foreign object into engagement with the ramp can not cam the slide to its open position, since it remains in its closed-latched position. While the sole insertion of a foreign object into engagement with the nose unlatches the slide, it remains in a closed position with the ledge blocking the insertion path to the receptacle contacts therebehind. Thus, access to either of the receptacle contacts is denied to a blade-like foreign object inserted into either one of the receptacle slots, rendering the safety receptacle of the present invention reliably child-resistant.

In an alternative embodiment of the invention, a secondary slide is added to cooperate with the ramp of the above-described primary slide and thereby block spurious attempts to access the plug-in contacts aligned with a T-shaped receptacle slot adapting the safety receptacle to accept standard electrical plugs of different blade configurations, i.e., either parallel or perpendicular to each other. In the primary slide closed-latched position, the secondary slide is latchingly retained by the ramp in a spring-biased closed position to completely obstruct the T-shaped slot. Access to the receptacle contacts is gained by a plug having mutually parallel blades only after the primary slide has been unlatched and cammed to its open position as described above. For a plug having mutually perpendicular blades, the initial unlatched movement of the primary slide toward its open position unlatches the secondary slide for cammed movement to its open, slot-unobstructing position. As a feature of the invention, the primary and secondary slide motions between their open and closed positions are mutually perpendicular to conserve space.

The invention accordingly comprises the features of construction, arrangements of parts and combinations of elements, all of which will be exemplified in the constructions hereinafter set forth, and the scope of the invention will be indicated in the claims.

For a better understanding of the nature and objects of the invention, reference may be had to the following detailed description taken in conjunction with the accompanying drawing, in which.

Corresponding reference numerals refer to like parts throughout the several views of the drawing.

DETAILED DESCRIPTION

Figure 1:
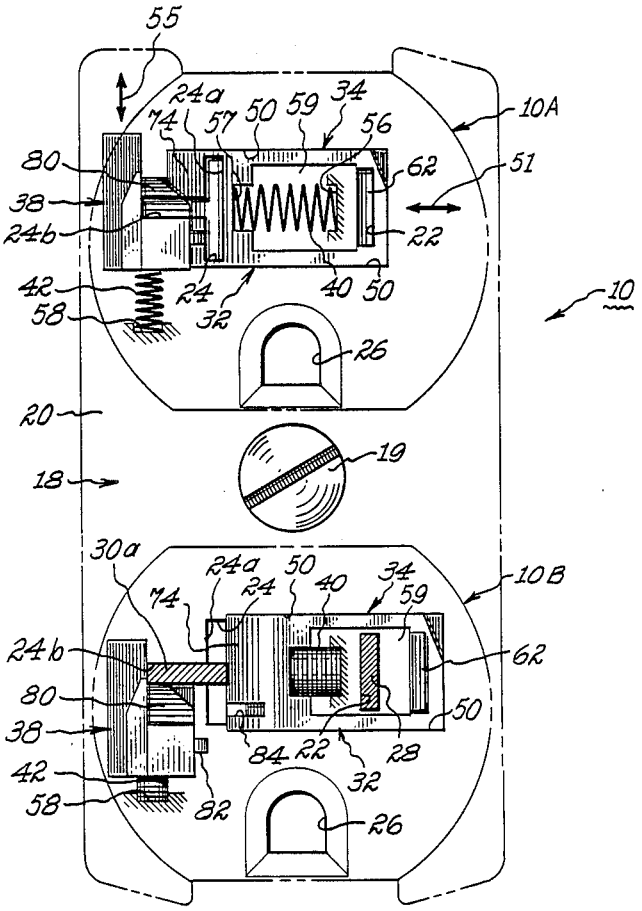
FIG. 1 is a plan view, partially in phantom line, of a duplex safety electrical receptacle embodying the present invention.
Figure 2:
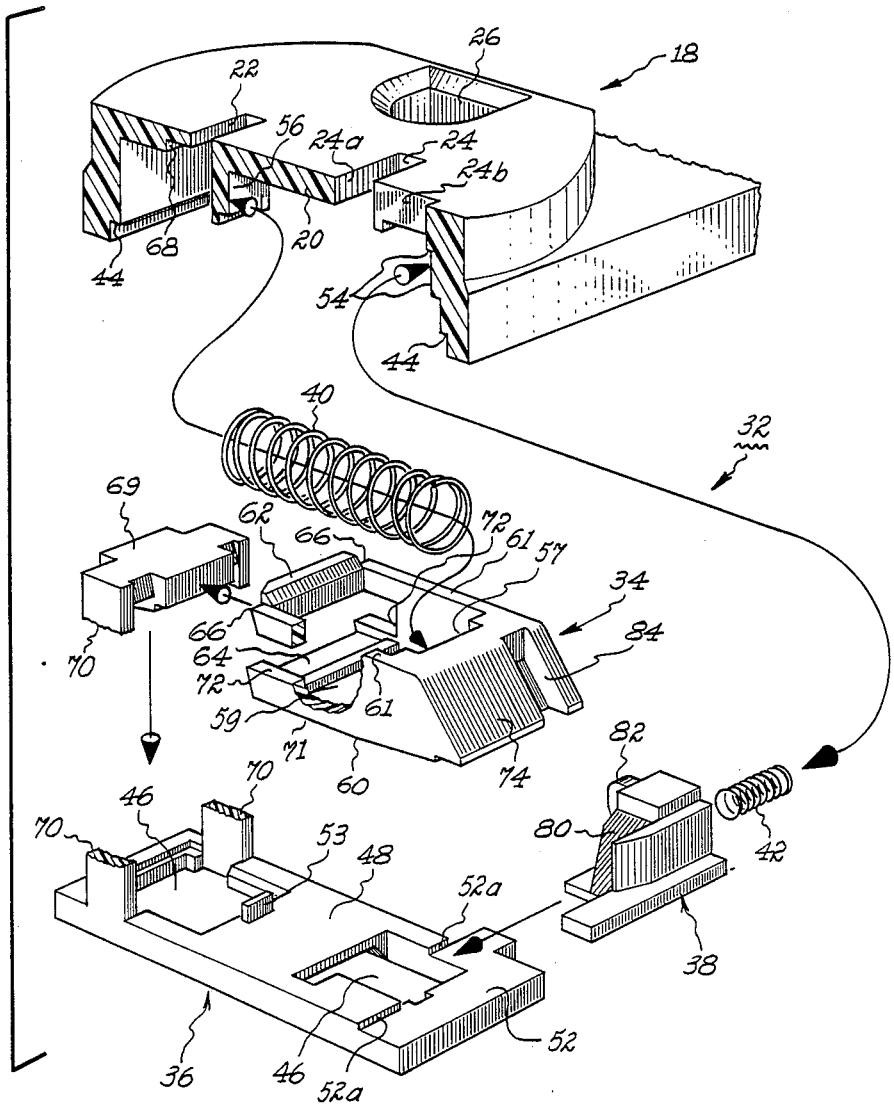
FIG. 2 is a fragmentary, exploded assembly view, partially broken away, of the safety electrical receptacle of FIG. 1.
Figure 3:
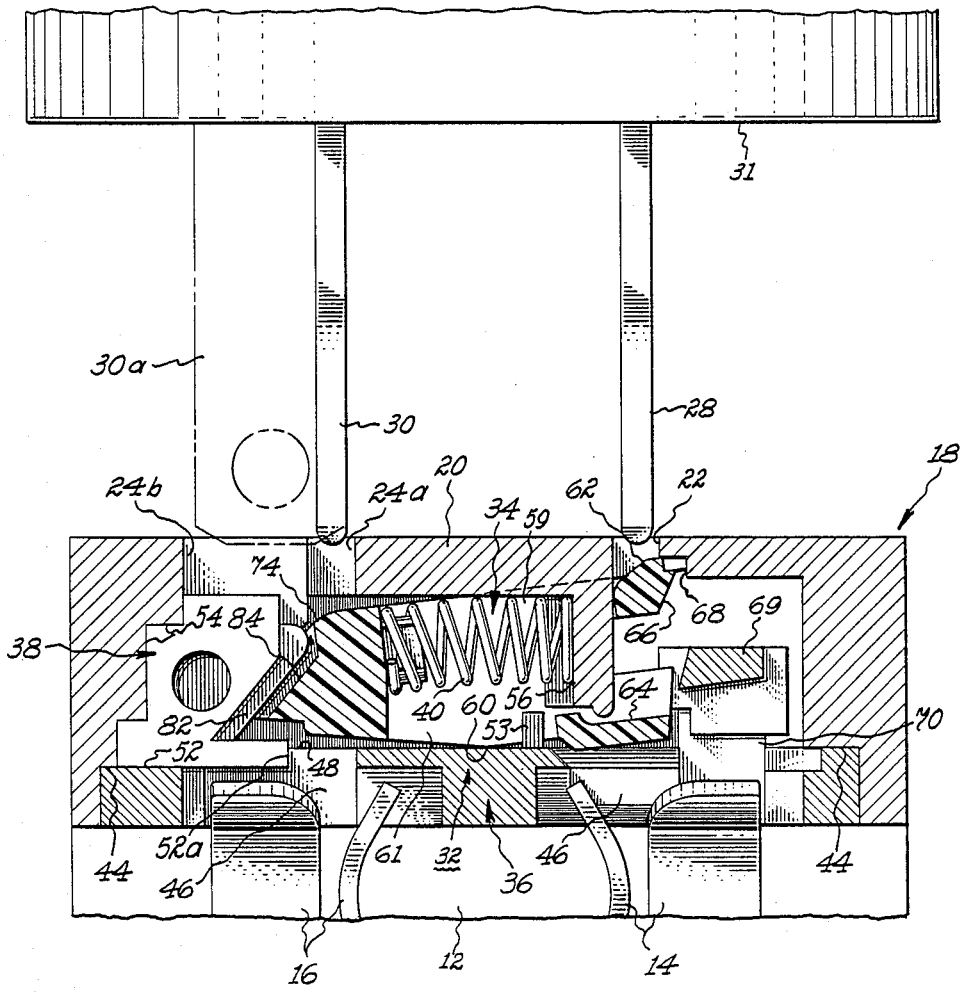
FIGS. 3 through 7 are a series of like sectional views illustrating the operation of the safety electrical receptacle of FIG. 1.

The present invention is illustrated in FIG. 1 in one of its embodiments as a duplex safety electrical receptacle, generally indicated at 10, having a pair of plug receptacles, generally indicated at 10A and 10B. The various parts of the duplex receptacle are conventionally contained within or mounted to a body 12, fragmentarily illustrated in FIG. 3, including line and neutral plug-in contacts, diagrammatically illustrated at 14 and 16, respectively (assuming the receptacle is wired properly). A cover, generally indicated at 18, is secured to the base by a screw 19, as seen in FIG. 1. For each plug receptacle 10A and 10B, the front wall 20 of cover 18 is formed with a rectangular-shaped slot 22, a T-shaped slot 24, and a D-shaped slot 26, as illustrated in FIGS. 1 and 2. As seen in FIG. 3, slot 22 is aligned with the line plug-in contacts 14, slot 24 is aligned with the neutral plug-in contacts 16, and slot 26 is aligned with ground plug-in contacts (not shown). Thus, in conventional fashion, slot 22 accepts the insertion of one blade 28, and slot 24 accepts a second blade which is either parallel to blade 28, as illustrated at 30, or orthogonal to blade 28, as indicated in phantom at **30*a*, and slot 26** accepts insertion of a prong, if present. These blade configurations represent the various types of standard electrical plugs (polarized and non-polarized, two and three bladed), a low voltage receptacle can encounter in service.

To render duplex receptacle 10 child-resistant in accordance with the present invention, a shutter mechanism, generally indicated at 32, is incorporated in cover 18 intermediate its front wall 20 and body 12. This shutter mechanism includes, as best seen in FIG 2, a primary slide, generally indicated at 34, a retainer, generally indicated at 36, a secondary slide, generally indicated at 38, a primary slide compression spring 40 and a secondary slide compression spring 42. Edge portions of retainer 36 are seated on internal ledges 44 formed in cover 18 to establish its position, and the retainer is clamped in place between the cover and base by uniting screw 19. The retainer is apertured, as indicated at 46, so as not to obstruct access to receptacle contacts 14 and 16. Primary slide 34 is supported immediately behind cover front wall 20 by a platform surface 48 of retainer 36 and is guided by opposed internal cover surfaces 50 for reciprocating movement in the directions indicated by arrow 51 between extreme open and closed-latched positions and a range of intermediate closed (unlatched) positions. Secondary slide 38 is also supported immediately behind the cover front wall by the retainer on a separate platform surface 52 and is guided by internal cover surfaces 54 and retainer edges **52*a* (FIG. 2) for reciprocating movement in the direction indicated by arrow 55 between open and closed positions. In FIG. 1, receptacle 10A is illustrated with its slides 34, 38 in their spring-biased closed-latched, blade insertion blocking positions, while receptacle 10B is illustrated with its slides in their open, blade insertion unblocking positions. Spring 40, accommodated in the slide open interior 59, acts between a cover depending abutment 56 and a surface 57 of primary slide 34 to bias this slide to its closed-latched position. An upstanding retainer tab 53 serves to maintain the spring end positioned against abutment 56. Spring 42, backed by cover depending abutment 58 (FIG. 1) biases secondary slide 38** to its closed position.

Referring jointly to FIGS. 2 and 3, when the primary slide is in its closed position, spring 40 rocks it in the counterclockwise direction (FIG. 3) about fulcrums 60 formed on the bottom edges of opposed arms 61 of the slide, which rest on retainer platform surface 48. This positions a transverse nose 62 carried by arms 61 in an obstructing position immediately behind receptacle slot 22. Underlying this nose, arms 61 carry a transverse barrier or ledge 64 disposed in the blade insertion path to line contact 14, fully blocking access thereto. The terminations of these arms at nose 62 are formed to provide laterally spaced latches 66 which are poised, while slide 34 is in its counterclockwise rocked, closed-latched position, to engage catches 68, depending from cover wall 20 adjacent each end of slot 22. Consequently, the primary slide is latched in its closed position, i.e., its closed and latched position, to which it is biased by spring 40. To unlatch the primary slide, slide nose 62 must be depressed to rock the slide clockwise on its fulcrums 60 and thus disengage latches 66 from catches 68. The primary slide is thus shifted to a closed-unlatched position, free to slide rightward (FIG. 3) toward its open position on the runner bottom edges 71 of arms 61, such motion being accommodated by the entry of elevated transverse guide member 69 into notches 72 in the arms. This guide member which is supported by upstanding retainer legs 70, provides with its supporting legs continuing guidance for the primary slide during movement from its closed-unlatched position to its open position.

It is important to note that, while the insertion of a blade-like object through slot 22 is effective to force nose 62 aside and shift primary slide from its closed-latched position, such insertion is incapable of propelling the slide away from a closed position. Continued insertion is blunted short of plug-in contacts 14 by underlying ledge 64 which is oriented normal to the insertion path leading thereto. Consequently, the primary slide can not be forced aside to expose these contacts by the spurious penetration of an object into the receptacle via slot 22. Moreover, upon withdrawal of the object, spring 40 immediately restores the primary slide to its closed-latched position.

To block spurious access to plug-in contacts 16, primary slide 34 is provided with a ramp 74 disposed immediately behind the portion **24*a* of T-shaped slot 24 oriented in parallel relation to slot 22. The surface of this ramp is sloped such that the insert of an object through slot portion 24*a* into engagement with the ramp exerts a force on the primary slide in a direction toward its open position. However, unless the slide has been unlatched and maintained so, the primary slide can not be moved away from its closed position by the insertion of a foreign object through slot portion 24a. Thus, primary slide 34 can be shifted from its closed-latched position to its open position only in response to the insertions of blade-like objects into slots 22 and 24 concurrently, such as occur when a standard electrical plug is normally inserted into either receptacle 10A, 10B**.

Figure 4:
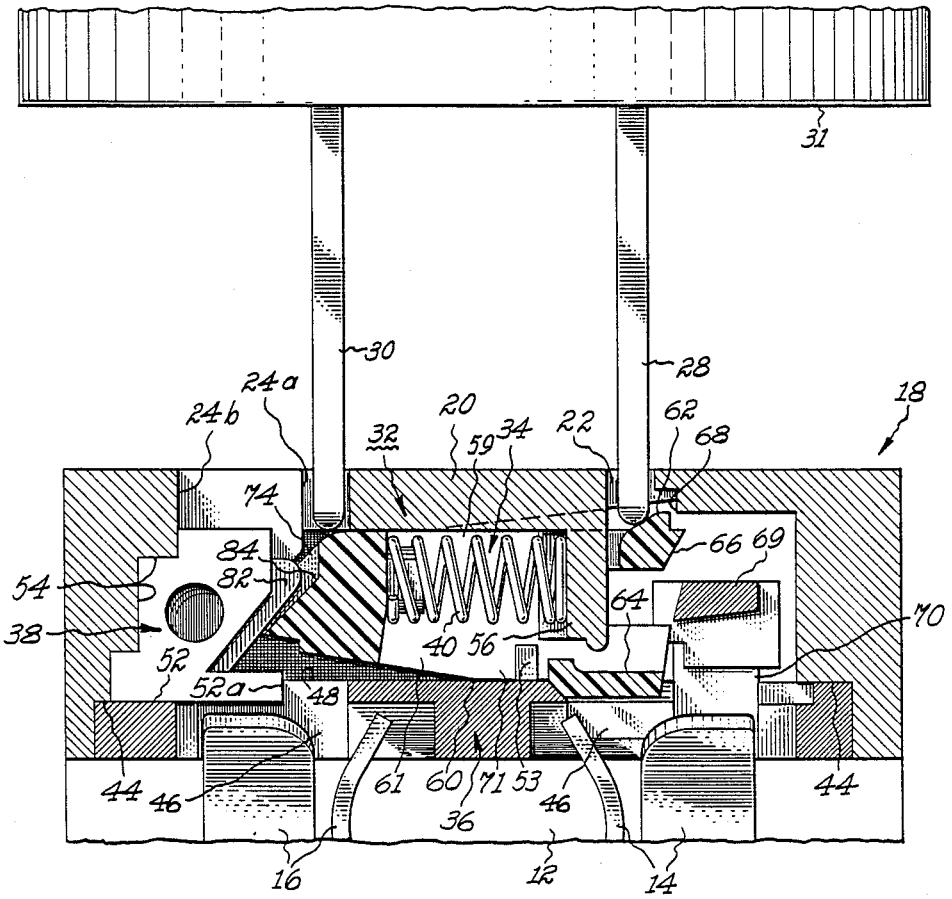
Figure 5:
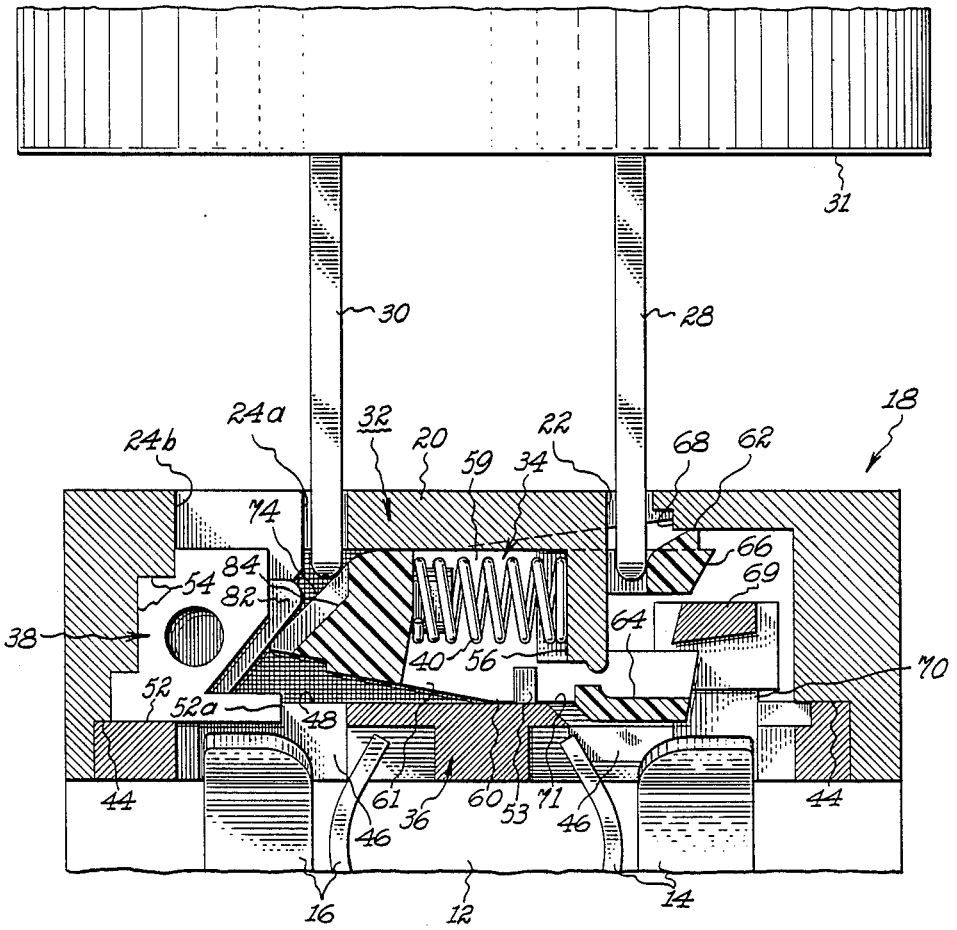
Figure 6:
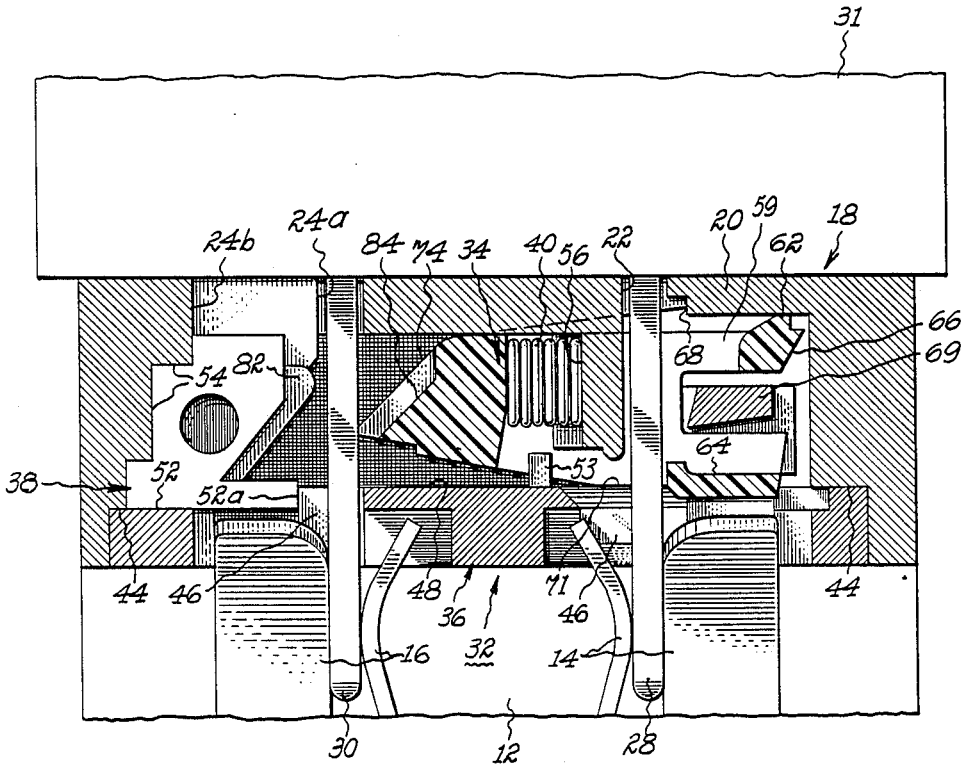

FIG. 4 illustrates this event. As blades 28 and 30 of an electrical plug 31 are inserted, the former first engages nose 62 before the latter engages ramp 74. This is due to the fact that the nose is more elevated than the ramp by virtue of spring 40 having rocked primary slide 34 on fulcrums 60 counterclockwise to its closed-latched position seen in FIG. 3. Thus, the initial engagement of blade 28 with nose 62 rocks primary slide 34 about its fulcrums in the clockwise direction to the closed (unlatched) position seen in FIG. 4. With continued insertion of the plug, blade 30 engages ramp 74, camming primary slide 34 rightwardly toward its open position, as illustrated in FIG. 5. Note that ledge 64 continues to block direct access to plug-in contacts 14, which are the live contacts assuming the receptacle is properly wired. Thus the primary slide is still in a closed-unlatched position. It is only until the primary slide is shifted completely to its open position by the penetration of blade 30 that ledge 64 fully uncovers contacts 14 to allow blade 28 to penetrate the slide interior opening 59 (FIG. 2) into plug-in engagement with these contacts, as illustrated in FIG. 6.

Figure 7:
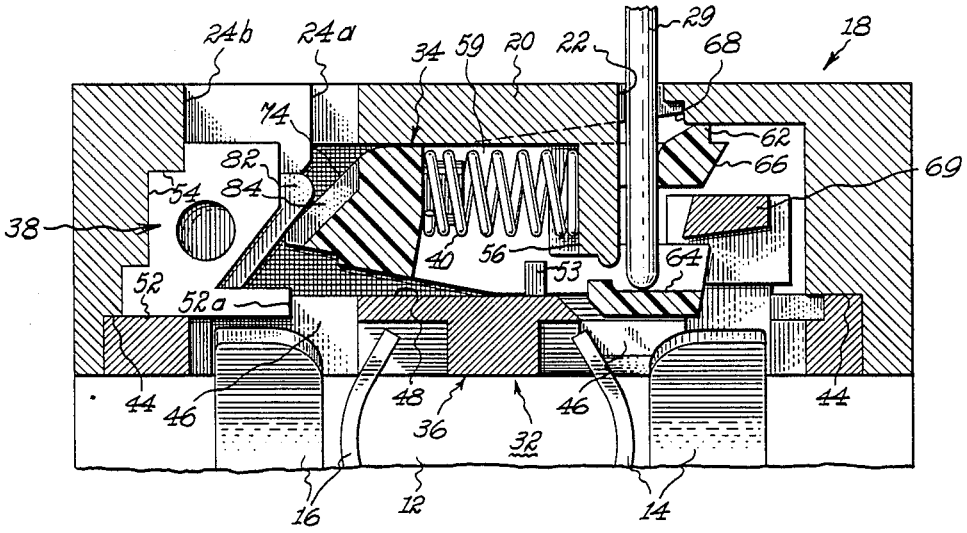

FIG. 7 illustrates the situation when a foreign object 29 is inserted through slot 22. Nose 62 is readily depressed to unlatch primary slide and can be forced aside to permit further penetration as the primary slide is incrementally shifted rightward. However, the primary slide is still in a closed, albeit unlatched position, and ledge 64 remains in blocking relation with contacts 14 to prevent continued penetration of the foreign object into contact therewith. It will be appreciated from FIG. 3 that the spurious insertion of a foreign object through slot 24 is blocked by ramp 74, and, since the primary slide is in its closed-latched position, it cannot be cammed rightward to its open position. Thus, access to plug-in contacts 16 is denied, which contacts would be live if the receptacle is not wired in accordance with convention.

The foregoing description applies to the embodiment of the invention wherein the cover is formed with slots 22 and slot portions 24a to thus only accept electrical plugs whose blades 28 and 30 are in parallel relation. In this embodiment, secondary slide 38 is unnecessary and would be omitted in practice, since ramp 74 is effective to fully block slot portion 24a. This is not the case for T-shaped slot 24 which can accept standard plugs either with blades 28 and 30 in parallel relation or blades 38 and 30a in orthogonal relation. Thus, in accordance with an alternative embodiment of the invention, secondary slide 38 is added to shutter mechanism 32. As noted above, this secondary slide is supported by retainer 36 and guided by both cover 18 and the retainer for reciprocating movement between open and closed positions along a path (arrow 55) which is normal to the primary slide reciprocating path (arrow 51) as seen in FIG. 1. Secondary slide is formed having a ramp surface 80 (FIGS. 1 and 2) and a latching tab 82. With the secondary slide raised to its closed position by spring 42, ramp surface 80 is situated behind the portion 24b of T-shaped slot 24, and tab 82 is lodged in a notch 84 formed in ramp 74 of primary slide 34 while in its closed-latched position. Thus, the secondary slide is latched in its closed-latched position as long as the primary slide is in its closed-latched position. Consequently, the insertion of a foreign object into either or both portions 24a, 24b of the T-shaped slot is blocked by primary slide ramp 74 and/or secondary slide ramp 80 as long as the two slides are in their closed-latched positions. When nose 62 is depressed and held so, primary slide 34 is unlatched and pivoted to its closed position. With initial opening movement of the primary slide, tab 82 is disengaged from notch 84 to unlatch secondary slide 38. Thus, both slides can then be cammed to their respective open positions by the penetration of plug blade 30a into engagement with plug-in contacts 16 in concert with the penetration of plug blade 28 into engagement with plug-in contacts 14, as described above and illustrated in FIGS. 3 through 6. Upon removal of the plug, the slides are returned to their closed-latched positions by their respective springs to deny access to the receptacle contacts for a foreign object inserted into either one of the receptacle slots 22, 24.

It is thus seen that the objects set forth above, including those made apparent from the preceding description, are efficiently attained, and, since certain changes may be made in the above constructions without departing from the scope of the invention, it is intended that all matters contained in the above description or shown in the accompanying drawing, shall be interpreted as illustrative and not in limiting sense.

Having fully described the invention, what is claimed as new and desired to secure by Letters Patent is:

1. A safety receptacle comprising, in combination:

A. a body supporting at least one set of separate first and second plug-in contacts;

B. a cover secured to said body and including a front wall having at least one set of first and second slots therein, said first slot being aligned with said first contacts and said second slot being aligned with said second contacts, whereby to accommodate the insertions of a pair of blades of a standard electrical plug through said first and second slots into respective electrical connections with said first and second contacts; and C. a shutter mechanism mounted intermediate said cover front wall and said first and second contacts, said shutter mechanism including (1) a stationary retainer, (2) a stationary catch, (3) a slid supported by said retainer for movement between an open position, a closed-latched position and intermediated closed-unlatched positions, said slide integrally formed including (a) a latch engaging said catch to latch said slide in said closed- latched position, (b) a latch actuating element disposed immediately behind said first slot in said slide closed-latched position, (c) a separate barrier underlying said latch actuating element to obstruct the insertion path between said first slot and first contacts at least in said slide closed-unlatched positions, and (d) a ramp obstructing the insertion path between said second slot and said second contacts in said slide closed and said slide closed latched positions, (3) a spring biasing said slide toward said closed-unlatched position and into said closed- latched position, (4) whereby, access to said first and second contacts requires the concurrent insertions of a pair of blades of an electrical plug respectively through said first and second slots to initially shift said slide from said closed-latched position to said closed unlatched position with said catch and said slide latch in disengaged relation by depression of said latch actuating element in response to insertion of one blade such as to then permit the engagement of the other blade with said ramp to cam said slide to said open position, thereby jointly removing said barrier and ramp from the blade insertion paths leading to said first and second contacts, respectively.

2. The safety electrical receptacle defined in claim 1, wherein said retainer further includes a platform surface, and said slide further includes a fulcrum resting on said platform surface, said slide pivoting on said fulcrum between said closed-latched and closed-unlatched positions.

3. The safety electrical receptacle defined in claim 2, wherein said retainer platform surface supports said slide for sliding movement between said closed-unlatched and open positions.

4. The safety electrical receptacle defined in claim 3, wherein said retainer further includes a transverse guide member elevated from said platform surface, and said slide is notched intermediate said latch actuating element and said barrier to accept said transverse guide member during slide movement between said closed-unlatched and open positions.

5. The safety electrical receptacle defined in claim 4, wherein said slide latch is in the form of a pair of transversely aligned latch surfaces, and said catch is in the form of a pair of transversely aligned catch surfaces depending from said cover front wall.

6. The safety electrical receptacle defined in claim 5, wherein said slide further includes a pair of transversely spaced arms joined at corresponding one ends with said ramp and joined at corresponding other ends with said latch actuating element and said barrier.

7. The safety electrical receptacle defined in claim 6, wherein said latch surfaces are provided by terminal surfaces of said arm other ends.

8. The electrical receptacle defined in claim 7, wherein said cover further includes guide surfaces for controlling slide movement between said closed and open positions.

9. The electrical receptacle defined in claim 8, wherein said cover further includes an internal abutment against which said spring acts to bias said slide to said closed-latched position.

10. The electrical receptacle defined in claim 9, wherein said retainer is clamped between said cover and said body.

11. A safety electrical receptacle comprising, in combination:

A. a body supporting at least one set of separate first and second plug-in contacts;

B. a cover secured to said body and including a front wall having at least one set of first and second slots therein, said first slot being aligned with said first contacts and said second slot being aligned with said second contacts, whereby to accommodate the insertions of a pair of blades of a standard electrical plug through said first and second slots into respective electrical connections with said first and second contacts; and C. a shutter mechanism mounted intermediate said cover front wall and said first and second contacts, said shutter mechanism including (1) a stationary retainer, (2) a stationary catch;

(3) a first slide supported by said retainer for movement between an open position, a closed-latched position and intermediated closed-unlatched positions, said slide integrally formed including (a) a first latch engaging said catch to latch said first slide in said closed-latched position, (b) a latch actuating element disposed immediately behind said first slot in said first slide closed-latched position, (c) a separate barrier underlying said latch actuating element to obstruct the insertion path between said first slot and first contacts at least in said first slide closed-unlatched positions, and (d) a ramp obstructing a first portion of said second slot in said first slide closed and said slide closed-latched positions, said ramp including a second latch, (3) a first spring biasing said first slide toward said closed position and into said closed-latched position, (4) a second slide supported by said retainer for movement between open and closed positions, said second slide including (a) a ramp surface obstructing a second portion of said second slot in said second slide closed position, and (b) a catch engaging said second latch in said first slide closed-latched position to retain said second slide in its said closed position, and (5) a second spring biasing said second slide to its said closed position, (6) whereby, access to said first and second contacts requires the concurrent insertions of a pair of blades of an electrical plug respectively through said first and second slots to initially shift said first slide from its said closed-latched position to its said closed-unlatched position to unlatch said first slide by depression of said latch actuating element in response to initial penetration of one blade such as to then permit the initial penetrating engagement of the other blade with said ramp to unlatch said second slide, where upon continued penetrating engagement of the other blade with said ramp and said ramp surface jointly cams said first and second slides to their open positions to remove said barrier from the blade insertion path leading to said first contacts and said ramp and ramp surface from the blade insertion path leading to said second contacts.

12. The safety electrical receptacle defined in claim 11, wherein said first slide further includes a fulcrum resting on said platform surface, said first slide pivoting on said fulcrum between said closed-latched and closed-unlatched positions.

13. The safety electrical defined in claim 12, wherein said retainer platform surface supports said first slide for sliding movement between its said closed-unlatched and open positions.

14. The safety electrical receptacle defined in claim 13, wherein said retainer further includes a transverse guide member elevated from said platform surface, and said first slide is notched intermediate said latch actuating element and said barrier to accept said transverse guide member during first slide movement between said closed-unlatched and open positions.

15. The safety electrical receptacle defined in claim 11, wherein said retainer supports said first and second slides for reciprocating movements between their respective said open and closed-unlatched positions along respective paths substantially perpendicular to each other.

16. The safety electrical receptacle defined in claim 15, wherein said second latch is in the form of a notch in said ramp, and said second slide catch is in the form of a tab engageable in said notch to latch said second slide in its said closed-latched position.

17. The safety electrical receptacle defined in claim 15, wherein said retainer includes first and second platform surfaces, said first slide includes a fulcrum resting on said first platform surface to provide for pivotal movement between said first slide closed-latched and closed-unlatched positions, and sliding movement between said first slide closed-unlatched and open positions, said second platform surface supporting said second slide for sliding movement between its said open and closed-latched positions.

18. The safety electrical receptacle defined in claim 17, wherein said retainer further includes a transverse guide member elevated from said platform surface and said first slide is notched intermediate said latch actuating element and said barrier to accept said transverse member during first slide movement between said closed-unlatched and open positions.

19. The safety electrical receptacle defined in claim 18, wherein said slide primary latch is in the form of a pair of transversely aligned latch surfaces, and said catch is in the form of a pair of transversely aligned catch surfaces depending from said cover front wall.

20. The safety electrical receptacle defined in claim 19, wherein said first slide further includes a pair of transversely spaced arms joined at corresponding one ends with said ramp and joined at corresponding other ends with said latch actuating element and said barrier, said latch surfaces being provided by terminal surfaces of said arm other ends.

* * * * *